United States Patent [19]

Leder

[11] 4,063,389

[45] Dec. 20, 1977

[54] SECURITY SLIDING DOOR SYSTEM

[76] Inventor: Erich O. Leder, 2032 S. 60th St., Omaha, Nebr. 68106

[21] Appl. No.: 674,542

[22] Filed: Apr. 7, 1976

[51] Int. Cl.[2] ..... E06B 3/42

[52] U.S. Cl. ..... 49/370; 49/372; 49/411; 49/449

[58] Field of Search ..... 49/372, 449, 425, 370, 49/366, 411, 410, 409; 160/37

[56] References Cited

U.S. PATENT DOCUMENTS

| | | | |
|---|---|---|---|
| 185,499 | 12/1876 | Conroy | 49/411 |
| 2,169,889 | 8/1939 | Waterbury | 49/372 X |
| 2,315,365 | 3/1943 | Christy | 49/372 X |
| 2,561,079 | 7/1951 | Trammell, Sr. | 49/372 |
| 3,009,984 | 11/1961 | Lindgren | 49/372 X |
| 3,100,916 | 8/1963 | McKinney | 49/372 X |
| 3,160,927 | 12/1964 | Busillo | 49/449 X |

*Primary Examiner*—Philip C. Kannan

[57] ABSTRACT

A double sliding door system in which a door stop centrally located between the doors works in combination with the positions of pin holes for receiving security pins so that security pins can be inserted through holes in the right and left door frames and will extend into the doors because of alignment of frame and door openings at times when the doors are against the stop in closed position for locking the sliding doors for 100% safety from opening from the outside of a home without destruction.

8 Claims, 5 Drawing Figures

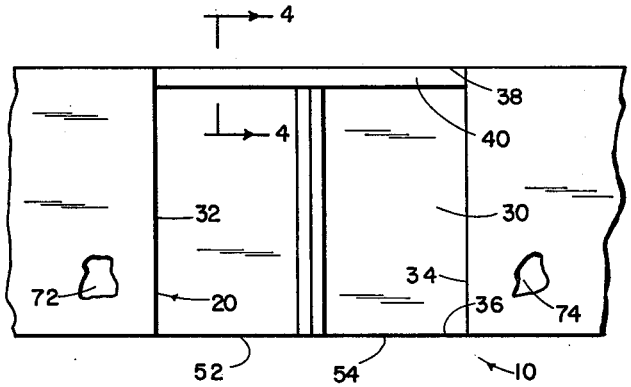
FIG. 1
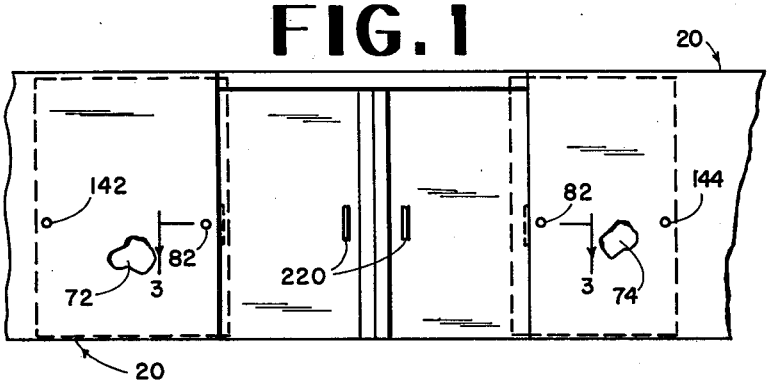
FIG. 2
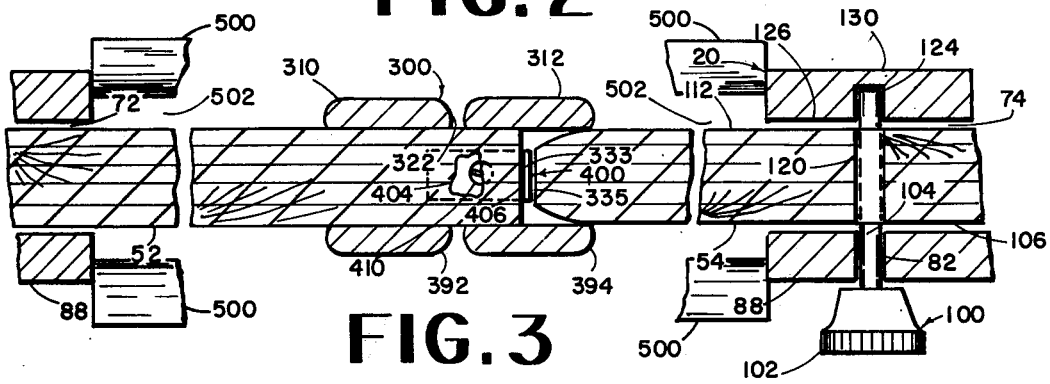
FIG. 3
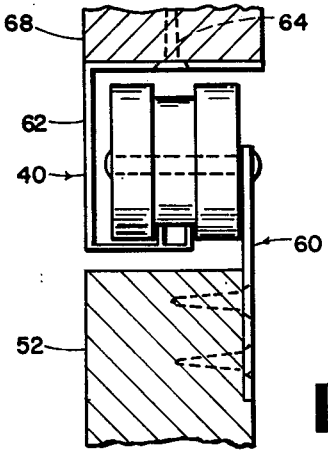
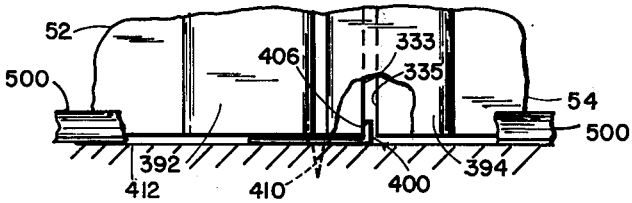
FIG. 4 FIG. 5

SECURITY SLIDING DOOR SYSTEM

FIELD OF THE INVENTION

This invention is in the field of sliding doors and particularly locks for sliding doors.

DESCRIPTION OF THE PRIOR ART

Double sliding doors have been very popular on the exterior walls of homes leading out on to the lawn and usually out to a patio or porch so that with the doors both pulled back the outdoors becomes a part of the indoors and the indoors a part of the outdoors.

However, burglaries have been many because it has been a simple operation for a burglar to either open sliding glass doors by unlocking or else by a small amount of breakage to reach through and open the sliding glass doors. After that it has been very easy for burglars to remove television sets and other heavy pieces of household furnishings from homes by means of the great convenience of wide open doors going clear to the floor providing a double width doorway that facilitates the looting.

It is realized that many users will prefer glass doors even with these disadvantages. However, in some areas the danger is much greater and it would be much superior to have doors which are not made of glass so that locking systems cannot be seen thus providing much higher security. However, even with solid doors burglars are often very capable in the use of crowbars and other tools for opening the doors. And so it is an object of this invention to provide a 100% security system for double sliding doors for homes.

The locking system I advocate is one in which security pins are inserted through openings in the wall areas or door frame areas receiving the sliding doors, so that the pins extend through and into the doors themselves. To accomplish this there must be an alignment between an opening in the wall area or door frame area and another opening in a door so as to receive the same security pin, such alignment occuring at a time when the door is closed.

However, when two doors are used as in the common home situation which usually involves double doors leading out to a patio, there is no stop on double doors of the prior art, against which the doors can stop and which latter creates an alignment of stop openings for a lock pin.

In the prior art when security pins have been used so as to extend through members attachable to a door frame and so as to enter a door to prevent it from being opened, such security pins have been mounted in very inconvenient locations such as at the floor level where one must bend over to use it or at the top of the door frame which is inconvenient to stretch to and unhandy for shorter persons.

In addition it is my opinion that security pins that have been heretofore proposed have been mounted in manners that are unnecessarily costly and in some cases they have been mounted in positions where they have been seen through a door, if the door be glass so that the intruder can see just where to cut a hole in the glass in order to reach in and pull the security pin.

Another disadvantage of the prior art has been that it is easy for an intruder to see where the joint is between two doors so that he is encouraged to insert a crowbar or other prying tool between the doors and attempt to pry the doors apart. Even if they would not be pryed apart, they would be substantially damaged and made unsightly.

SUMMARY OF THE INVENTION

A primary object of this invention is to provide a security double sliding door system in which a door stop is centrally located between the doors and works in combination with the position of pin holes for receiving right and left security pins so that the security pins can be inserted through holes in the right and left door frames and will extend into the doors because of alignment of frame and door openings at times when the doors are in abutment with the stop for locking the sliding doors in closed position for 100% safety from opening of the doors from the outside of a home without destruction.

Still another object is to provide means for preventing the stop member from being struck with the foot as a person walks across the floor with the stop member being disposed at the bottom portions of the doors.

A further object of the invention is to place the security pin recesses at convenient heights on a door, somewhere in the middle third of the door preferably, as regards to the height of the door so as to avoid the disadvantages of needing to stoop or stretch.

A further object is to provide security pin storage openings on the right and left sides of the door frame, and in position such as to be horizontally spaced from the locking openings and such that when the doors are opened the security pins can be placed in the storage openings where they will not extend through the respective doors, preferably, and are simply available to be removed from the storage recesses for locking use.

A still further object of the invention is to provide door edge concealing portions which give the impression to an intruder on the outer side of the door, that the door edges of the respective doors are disposed in a position which actually is a position lapping a single one of the doors whereby insertion of a tool between the protruding portions which extend vertically will be frustrated since there is no separation place between the doors there at all, one of the doors having a recess in its edge facing the other door so that the other door can be disposed in the recess where its edge can be concealed from an intruder on the outer side of the doors.

A particular object is to provide for simple operating of security pins which children can operate, whereby they are operable without the use of threads. They are also operable by persons not having the strength to pull against compression springs.

Another object is to avoid security pins having threads on them because it requires time to unscrew such a security pin as might be a hazard when speed of opening is necessary in case of fire.

Still another object is to provide a door having simplicity and economy and which is nearly 100 percent burglar-proof as possible and whereby nothing less than major destruction is needed to force entry as would make much noise that burglars do not want to make.

A further object is to provide a locking system that works well on both glass doors and wooden doors.

Another object is to provide a door locking system which can be visibly seen to be locked from many feet away. At a time when a person is ready to retire for the evening and wishes to check the locks, this can be done effectively by simply viewing the door to see whether or not the locking pins are in storage positions or in locking positions, as is important because a person might be killed by an intruder who might enter through an unlocked door which was mistakingly thought to be locked if it were not designed so that it could be easily determined whether it was locked or unlocked, and so determined even at a distance from the door.

A further object of the invention is to provide a security sliding door system, the principles of which will work equally well with a single door as with a double door.

BRIEF DESCRIPTION OF THE DRAWING

FIG. 1 is a side elevation of a door frame having a pair of sliding doors of this invention mounted thereon, broken away portions of the wall which forms a part of the door frame being identified, the doors being shown in closed position, as seen from the outer side of the door.

FIG. 2 is a side elevation of the security sliding door system of this invention, as seen from the inner side, with dotted lines indicating positions of the doors at times when they are open, broken away portions of the door frame identifying a pair of door receiving recesses.

FIG. 3 is a sectional view taken horizontally through the door at the level of a security pin and looking downwardly, the doors being shown in cross-section, and a portion broken away to show the bottom portion of a stop member.

FIG. 4 is a sectional view taken vertically through a supporting track.

FIG. 5 is a side elevation detail of the middle of the sliding door system of this invention, showing the position of a stop member. The threshhold members in FIG. 5 are broken away at their center in order to show parts of the door there behind.

DESCRIPTION OF THE PREFERRED EMBODIMENT

Referring to FIG. 1, the security sliding door system of this invention is generally indicated at 10, and comprises a door frame, generally indicated at 20, and having a doorway through which persons can pass as indicated at 30. The frame has left and right edges 32 and 34, a bottom edge 36 and a top edge 38 in which a track 40 is mounted, extending horizontally between the frame edges 30 and 32.

A pair of sliding doors comprising a left door 52 and a right door 54 are mounted in the doorway and, as best seen in FIG. 4, the door 52, as is the case also with the door 54, are suspended on suitable roller suspension means, generally indicated at 60, which are adapted to roll on a track bar 62 fixed by screws 64 to the upper side of the door frame, as indicated by a member 68, which is not shown in FIG. 1, but is understood to be above the track 40.

The left and right doors 52 and 54 can either one be called a first door, and the other can be called a second door. In that same sense all parts of the security sliding door system 10 of this invention are in all respects duplicate as regards each of the doors so that these various parts can either be called first or second, depending upon which door they are associated with. Consequently, to save space in description the words first and second will not be repeated throughout this specification.

The door frame 20 has left and right vertically extending door storage recesses, as indicated at 72 and 74, in which the doors 52 and 54, respectively, can be received for storage. The recesses 72 and 74 are best seen in FIG. 3 and are in alignment with the doors 52 and 54, which latter are themselves in alignment.

It is preferred that the doors 52 and 54 be made of plywood or other solid material, through which an intruder cannot see.

The door frame has left and right locking opening 82 extending from the inner side of the door frame, as indicated by the inner surface 88 in FIG. 3, to the storage recess 72 or 74 respectively.

A security pin is provided for the left door and another one for the right, the latter being illustrative of the two and being seen at 100. The pin 100 has a handle 102 and a shank 104, and the doors 52 and 54 respectively have security pin receiving openings 120 extending preferably completely therethrough, but at least entering from the inner-side 106 of the respective door.

The shank 104 of the pin 100 extends in locking position through the door security pin receiving opening 120 and past the outer side 112 of the respective door, and from there further extends into a notch 124 in the side 126 of an outer portion 130 of the door frame 20, the outer portion 130 extending along the outer side of the door storage recess 74.

A similar construction is found on the left side, but it is not illustrated in FIG. 3, because it is identical.

The door frame 20 further has left and right security pin storage openings 142 and 144, which latter are horizontally spaced from the locking openings 82, and extend through the door frame 20 from its inner side and on into the outer frame member 126 also to form other notches, similar to the notches 124, but not shown, since the entire construction of a storage opening and its reception of a security pin for storage is identical to that illustrated in the right hand side of FIG. 3.

It is important that the security pin openings 82 and 144 be at a convenient height. For example, they could be at the height of the knobs of conventional doors, since that height has been chosen by convention throughout the years as a convenient height for operation by both children and adults. However, the storage openings and locking openings could be higher on the door. One important factor is, however, that they are preferably not simply way down by the floor or clear up at the top of the door since such places are very inconvenient.

As illustrated in FIG. 2, the doors can have handles, if desired, as seen at 220.

Referring to FIG. 3, a door edge concealing assembly is generally indicated at 300. Its purpose is designed to give the impression to an intruder approaching the door from the outer side that the vertical opening between the right and left doors is between two outwardly protruding vertically extending distraction portions or distraction members 310 and 312, which are preferably very slightly spaced apart, along their adjacent vertical edges with both of their adjacent vertical edges disposed in a lapping relationship with a single one of the doors, such as the left door 52, as shown in FIG. 3, whereby it might seem to the intruder that the opening between the doors 52 and 54 might be between the protruding portions 310 and 312, whereby he might try to insert a prying tool in that crack and find himself frustrated.

The actual separation place between the doors 52 and 54 is represented by the ends 333 and 335 of the respective doors 52 and 54, but it will be understood that the end 333 is disposed in a lapping relationship with the right hand one 312 of the protruding portions 310 and 312. The right hand one 312, therefore, laps the left hand door 52 but also extends to the right in a protruding to the right relationship so that the door 54 can slide behind it sufficiently that its inner edge 335 is disposed in a substantial lapping position with respect to the right protruding portion 312 where it cannot be seen by an intruder.

In FIGS. 3 and 5 a stop member assembly, generally indicated at 400, is shown and it has an upwardly extending stop member 406 fixed to a horizontally extending base portion 404, which latter is screwed to the floor 412 by a screw 410.

As measured from left to right the stop 406 is very thin to separate the doors 52 and 54 to the minimum, although it will be seen in FIG. 3 that the vertically extending members 312 and 394 attached to the door 52 would prevent the terminal edge of the door 54 from being seen any way.

The stop member 406 is disposed in a position so as to limit movement of the doors 52 and 54 in door closing directions so that when the doors 52 and 54 are against the stop member 406, then the first door security pin 100 can have its shank 104 inserted through the right locking opening 82 of the door frame 20, and through the right door security pin receiving opening 120 for the right door 54 and into the notch 124 for the right door, since the notch 124 and the locking opening 82 for the right door 54 are already in alignment, and at times when the right door 54 is against the stop 406, then the right door security pin receiving opening 120 will be disposed in alignment with the notch 124 and with the right door locking opening 82.

The stop member 406 has this same relationship with the left door 52 so that a similar locking pin system with alignment can be used to lock the left door 52 when the left door 52 is in engagement with the stop 406.

In FIGS. 3 and 5 outside and inside threshold members 500 are secured to the floor 412 by any suitable means, for example, glue could be used. The outside and inside threshold members 500 are spaced apart and are horizontally elongated and provide a door groove 502 therebetween, as seen in FIG. 3, in which the doors 52 and 54 slide with the threshold members 500 guiding the doors 52 and 54.

In FIGS. 3 and 5 it can be seen that the threshold members 500 extend upwardly beyond the stop member 406 so as to prevent a person who is walking through the door from tripping over the stop member 406. Expressed in another way, the stop member 406 is disposed down inside the groove 502 where it is protected from being tripped over.

In this sense the important part of this construction is that there is, first of all, a groove 502, secondly, that the doors 52 and 54 extend downwardly into the groove 502 and, thirdly, that the stop member 406 projects upwardly in the groove 502 sufficiently to engage those inner ends 333 and 335 of the doors 52 and 54 which extend vertically.

The outside and inside threshold members 500 together comprise a groove providing or groove making assembly or a grooved stop guarding means although the latter term would seem to apply also only if the floor beneath were considered.

I claim:

1. A security sliding door system comprising a door frame having a doorway, a first sliding door mounted in said door frame, said door frame having a vertically extending first door storage recess in one side thereof and aligned with said first door, means mounting said first door slidably in said door frame whereby said first door can slide from a storage position in which it is at least mostly in said first storage recess to a doorway closing position for closing a part of said doorway, said door frame having a first door locking opening extending from an inner side of said door frame to said first door storage recess, a security pin, said first door having a first door security pin receiving opening entering from its inner side, said first door security pin receiving opening being disposed in registry with said first door locking opening at times when said first door is in a certain closing position in said doorway, and a security pin in said first door locking opening and also in said security pin opening of said door whereby said first door is locked into said closing position, a second sliding door in said door frame, said system having a duplicate of all parts above mentioned in similar operational positions with respect to said second door and correlating said second door with said door frame for storage and locking, said second door sliding toward and away from said first door and when closed said doors substantially abutting each other, said doors sliding in substantially the same plane, a stop means disposed in a position so as to limit movement of said doors in door closing directions so that when said doors are against said stop means said first door security pin receiving opening is in registry with said first door frame locking opening so that said security pin can be easily inserted at least through part of said door frame and into said first door, and means attaching said stop means to said door frame.

2. The security sliding door system of claim 1 having said door frame provided with a first security pin storage opening horizontally spaced from said first locking opening and also horizontally spaced from that edge of said doorway which is adjacent to said first door by substantially the width of said door and extending through said door frame from the inner end of said frame to said first door storage recess whereby at times when said first door is open and in its storage position said security pin can be stored in said first storage opening, said first storage opening being horizontally spaced in a direction away from said doorway from the storage position of that edge of said first door which is disposed closest to the center of said first storage recess at times when said first door is closed, said security pin being storable in said first security pin storage opening in said door frame.

3. The security sliding door system of claim 1 having said security pin being freely received in said first door locking opening and also freely received in said security pin opening in said door so as to be freely insertable and removable by means of lineal movements alone.

4. The security sliding door system of claim 1 having said means attaching said stop means to said door frame including having said door frame including the floor under said door and means attaching said stop means to the floor under said doors, two horizontally spaced threshold pieces extending along the outer and inner sides of said doors respectively and secured to said floor, said threshold pieces having a space therebetween receiving the bottoms of said doors, said threshold pieces serving to protect a person from striking said stop means with his foot while passing through said doorway.

5. The security sliding door system of claim 4 having one of said doors having a door edge concealing assembly mounted thereon comprising two vertically extending distraction members attached to the outer side of one of said doors, said distraction members having adjacent vertical parallel edges horizontally spaced apart slightly so as to seem like they themselves are at the adjacent ends of two closed doors, said one door on which said distraction members are mounted having a certain end surface portion adjacent to its outer side and adjacent also to the other of said doors when said doors are closed, one of said distraction members lapping said certain end surface portion of said one door and also lapping the other of said doors when said doors are closed so as to prevent a person on an outer side of said door from seeing said certain end surface portion of said one door and thereby making it much more difficult for a person to insert a crowbar between said doors.

6. The security sliding door system of claim 1 having said means attaching said stop means to said door frame including having said door frame including the floor under said door and means attaching said stop means to a portion of the floor under said doors, grooved stop guarding means at the bottom of said doors and fixed to portions of said floor and having an upwardly opening elongated groove therein receiving the bottoms of said doors and receiving said stop means, said stop guarding means extending substantially to the top of said stop means and serving to deter a person from striking said stop means with his foot while passing through said doorway.

7. The security sliding door system of claim 6 having said stop guarding means comprising a pair of spaced threshold members disposed one on each side of said door and projecting above the level of said floor.

8. A security sliding door system comprising a door frame having a doorway, a first sliding door mounted in said door frame, said door frame having a vertically extending first door storage recess in one side thereof and in line with said first door, means mounting said first door slidably in said door frame whereby said first door can slide from a storage position in which position it is mostly in to a doorway closing position in which it closes a portion of said doorway, a second sliding door in said door frame, said system having a duplicate of all parts above mentioned in similar operational position with respect to said second door and correlating said second door and said door frame, said second door sliding toward and away from said first door and when closed substantially abutting said first door and sliding in substantially the same plane as said first door, one of said doors having a door edge concealing assembly thereon comprising two vertically extending distraction members attached to the outer side of one of said doors, said distraction members having adjacent vertical parallel edges horizontally spaced apart slightly so as to seem like they themselves are at the adjacent ends of two closed doors, said one door having a certain end surface portion adjacent to its outer side and adjacent to the other of said doors when said doors are closed, one of said distraction members lapping said certain end surface portion and also lapping the other of said doors when said doors are closed so as to prevent a person on the outer side of said doors from seeing said certain end portion of said one door whereby said distraction members make it more difficult for such a person to insert a crowbar between the adjacent edges of said doors.

* * * * *